United States Patent [19]

Nomura et al.

[11] Patent Number: 4,704,978

[45] Date of Patent: Nov. 10, 1987

[54] SEWING MACHINE HAVING AN AUTOMATIC CONTROL SYSTEM

[75] Inventors: Etsuzo Nomura; Tetsuo Kozawa; Yasuo Sakakibara, all of Nagoya, Japan

[73] Assignee: Brother Kogyo Kabushiki Kaisha, Nagoya, Japan

[21] Appl. No.: 921,297

[22] Filed: Oct. 21, 1986

[30] Foreign Application Priority Data

Oct. 28, 1985 [JP] Japan ..... 60-241202

[51] Int. Cl.[4] ..... D05B 69/22

[52] U.S. Cl. ..... 112/275; 112/121.11; 112/121.24; 112/239

[58] Field of Search ..... 112/239, 275, 284, 237, 112/315, 121.11, 121.24

[56] References Cited

U.S. PATENT DOCUMENTS 3,688,714 9/1972 Makihara et al. .
4,478,160 10/1984 Ohniwa ..... 112/275
4,491,080 1/1985 Hager ..... 112/121.11 X
4,538,533 9/1985 Ohchi et al. .
4,587,911 5/1986 Kinoshita ..... 112/239

FOREIGN PATENT DOCUMENTS 0117713 9/1984 European Pat. Off. .
47-17589 5/1972 Japan .
60-40876 9/1985 Japan .
1167986 10/1969 United Kingdom .

*Primary Examiner*—Werner H. Schroeder
*Assistant Examiner*—Andrew M. Falik
*Attorney, Agent, or Firm*—Jordan and Hamburg

[57] ABSTRACT

A sewing machine has an automatic control system. This system provides for an automatic sewing mode for sewing according to previously stored sewing data and an ordinary sewing mode for sewing independently of the stored sewing data. When an interruption signal is generated by an interruption signal generating device during sewing process in the automatic sewing mode, the ordinary sewing mode is set and the pressure on the presser foot is released. Therefore, it is capable of smoothly feeding a material when feeding direction of the material is varied.

9 Claims, 11 Drawing Figures

SEWING MACHINE HAVING AN AUTOMATIC CONTROL SYSTEM

BACKGROUND OF THE INVENTION:

1. Field of the Invention

The present invention relates to a sewing machine which forms stitches by controlling operations both of a stitch forming device and of a work fabric feeding device in accordance with a selectively preset mode, and more particularly, to a sewing machine which is capable of releasing a fabric holding pressure according to the mode.

2. Description of the Prior Art

Generally speaking, a sewing machine is equipped with a presser foot for imparting a fabric holding pressure to a work fabric. Each of the sewing machines, which are disclosed, for instance, in the specifications of U.S Pat. Nos. 3,688,714 and 4,538,533 includes a presser foot that is so biased as to move downwards by a spring. When commencing a sewing operation, the above-described presser foot is descended, and the fabric holding pressure corresponding to the biasing force of the spring is applied on the work fabric.

However, since the foregoing presser foot of the sewing machine is disposed at a descending position at which it usually presses the work fabric during the sewing operation, it is unfeasible to automatically release the fabric holding pressure of the presser foot during an automatic sewing operation based on sewing data which are stored beforehand in a storage device.

For this reason, the sewing that will hereinafter be mentioned becomes impractical, this bringing about an inconvenience. To be specific, in order to sew a piece of fabric such as a work fabric having hems which intercross each other to a plain cloth, provided that the sewing data relative to rectilinearity along the hems are stored in the storage device, it is unfeasible for the sewing machine to form circularly arc stitches at a portion where a feeding direction of the fabric is varied while releasing the pressure at this feeding direction varying portion by interrupting the sewing operation on the basis of the sewing data.

SUMMARY OF THE INVENTION

Accordingly, it is a primary object of the present invention to provide a sewing machine which is capable of performing an ordinary sewing operation regardless of its sewing data by interrupting an automatic sewing operation based on the sewing data that are previously stored in a storage device. A further object of the invention is to provide a sewing machine capable of smoothly feeding out the fabric at a feeding direction varying portion by releasing a fabric holding pressure of a presser foot concurrently with the above-mentioned interruption.

To this end, according to one aspect of the invention, there is provided a sewing machine which comprises: a first control means having a plurality of modes for controlling both a means for forming stitches and a means for feeding a work fabric, this first control means being possessed of an automatic mode in which to form the stitches in accordance with data and of an ordinary mode in which to form the stitches regardless of the above-described data; and a second control means for setting the first control means in the ordinary mode and for activating an actuating means.

In the preferred embodiments of the present invention, the aforementioned actuating means essentially consists of a servo solenoid having a protractible and retractable armature and of a kinetic transmitting mechanism for transmitting protractive and retractive motions of the amarture to the presser foot, this kinetic transmitting mechanism being disposed between the amarture of the servo solenoid and the presser foot.

BRIEF DESCRIPTION OF THE DRAWINGS

FIG. 1 is a front view of a sewing machine;

FIG. 2 is a perspective view showing presser foot actuating mechanism;

FIG. 3 is a perspective view showing a feeding mechanism;

FIG. 4 is a partially expanded view in section of the feeding mechanism;

FIG. 5 is a partially expanded view showing a fabric end detecting device;

FIG. 6 is an expanded front view of a control panel;

FIG. 7 is a plan view of a work fabric;

FIG. 8 is a block diagram showing a control system of the sewing machine;

FIGS. 9 and 10 are flow charts each showing control programs of the sewing machine.

DETAILED DESCRIPTION OF THE PREFERRED EMBODIMENTS

Figure 1:
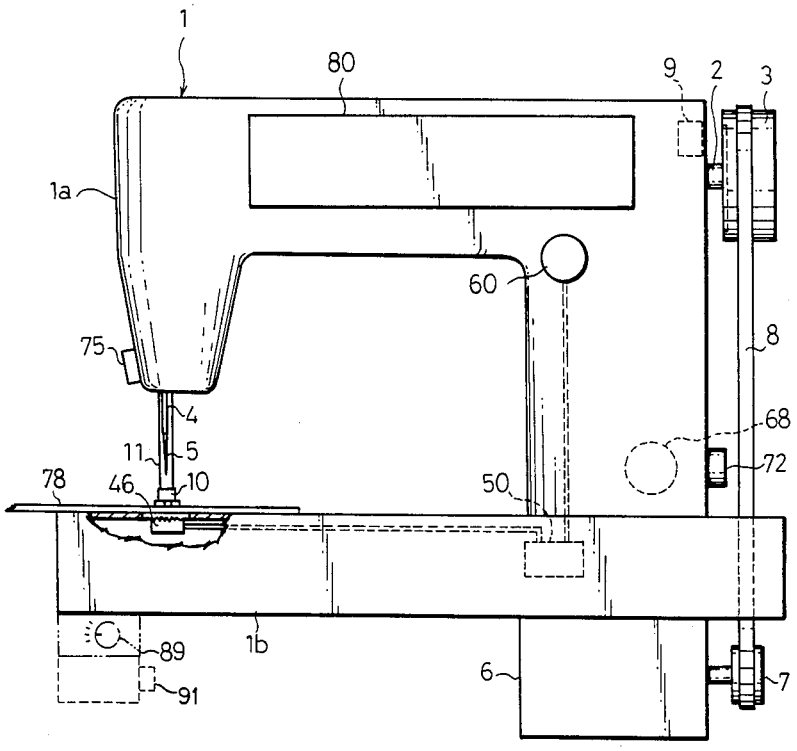
FIGS. 1 to 10 in combination show one embodiment of the present invention.
Figure 4:
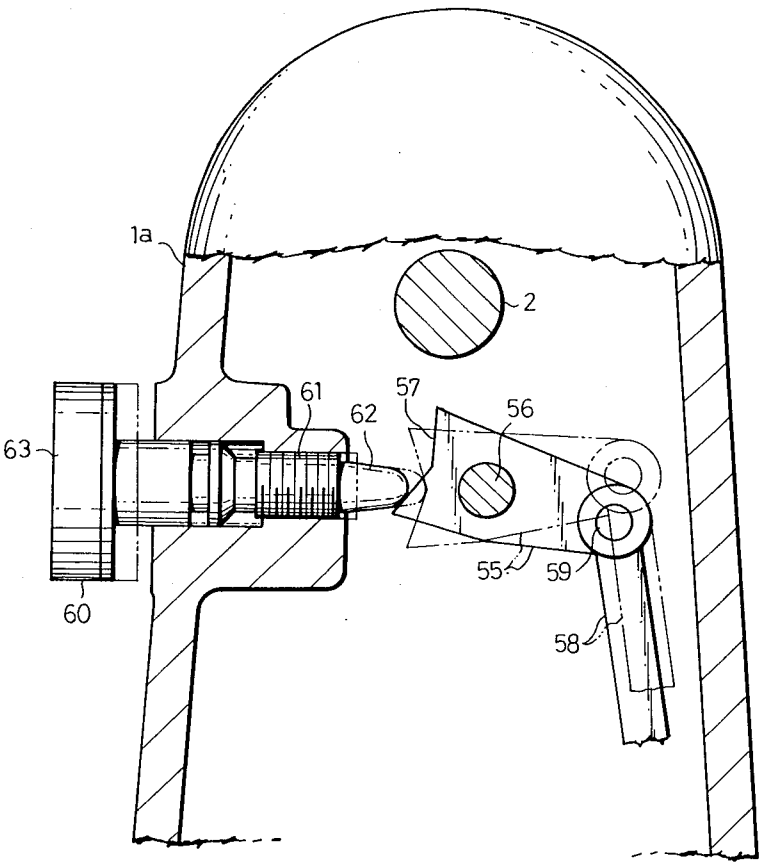

One embodiment of the present invention will hereinafter be described at full length with reference to the accompanying drawings. As illustrated in FIGS. 1 and 4, a main shaft 2 is rotatably supported within an arm 1*a* of a machine frame 1, and a pulley 3 is fixed to the right end thereof. A needle bar 4 is so supported by the arm 1*a* as to be vertically movable, and a needle 5 is attached to the lower end thereof. The main shaft 2 rotates through the intermediary of a pulley 7 provided on a motor shaft and of a belt 8 by the rotation of a motor 6 disposed at the lower portion of a bed 1*b* of the machine frame 1. Accompanied with the rotation of the main shaft 2, the needle 5 penetrates a work fabric 78 on the work fabric supporting surface of the bed 1*b* and keeps on moving vertically, whereby stitches are formed on the work fabric 78 in coorperation with a loop taker (not illustrated) provided in the bed 1*a*.

A needle position detector 9 for detecting the top and bottom dead points of the needle 5 is so equipped in the arm 1*a* as to stand vis-a-vis with the pulley 3 on the main shaft 2. A presser bar 11 having a presser foot 10 is supportingly provided in a vertically movable manner at the lower end of the arm 1*a*, this presser bar being disposed behind the needle bar 4.

Figure 2:
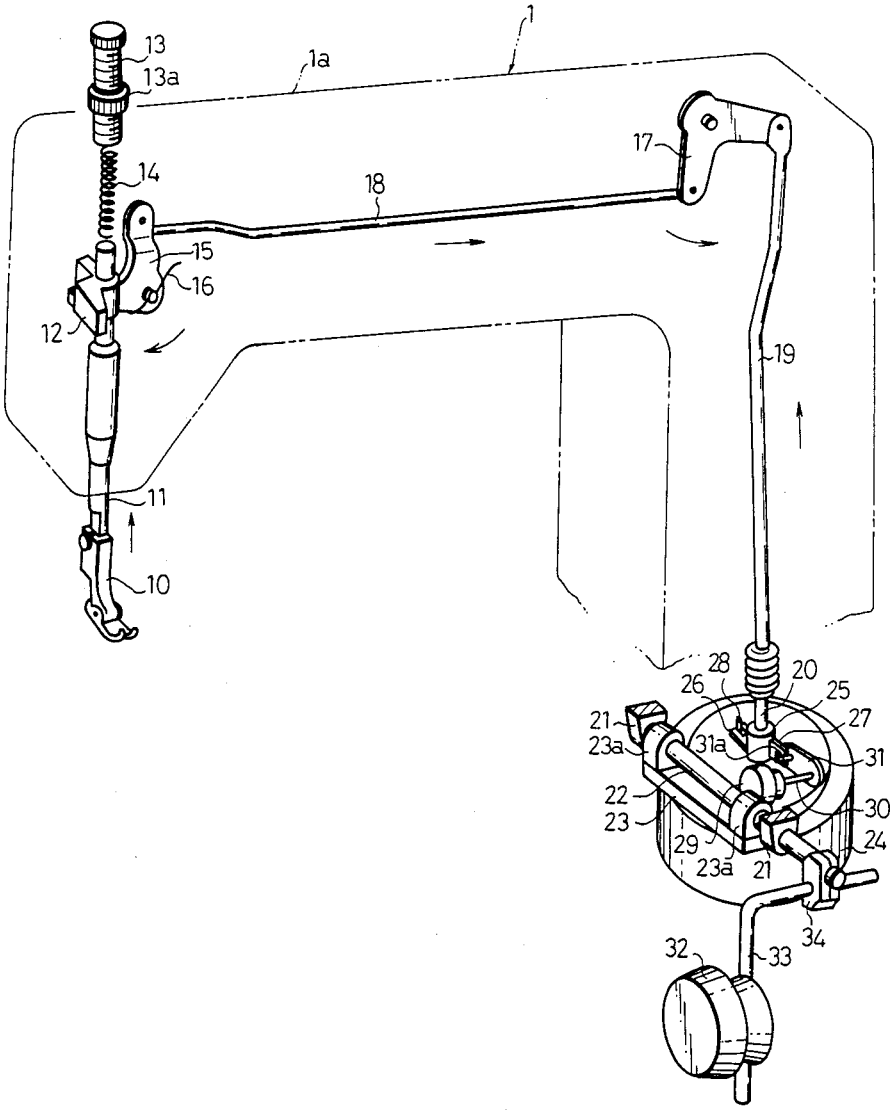

A needle bar clamp 12 is, as depicted in FIG. 2, fixed to the upper portion of the presser bar 11; and an adjusting screw 13 is driven into the arm 1*a* such as to be proximate to the upper end of the presser bar 11. A presser bar spring 14 is disposed between the adjusting screw 13 and the presser bar 11 within the arm 1*a*. A spring pressure of the presser bar spring 14 is variably adjusted by the turning operation of the adjusting screw 13; the adjusting screw 13 is fixed by a lock nut 13*a* at its variable adjustment position; and at the same time a holding pressure corresponding to a spring pressure of the presser bar spring 14 is applied on the work fabric 78.

A first rocker lever 15 is rotatably so supported within the arm 1*a* as to be vicinal to the needle bar clamp 12 and is rotationally biased by dint of a spring 16 in the direction in which to engage with the needle bar clamp 12. A second rocker lever 17 corresponding to the first rocker lever 15 is likewise rotatably supported within the arm 1*a*, one crossarm of which is connected to the first rocker lever 15 by means of a connecting bar 18; and the other crossarm thereof is connected to an actuating bar 19.

On the other hand, as shown in FIG. 2, a substantially bar-like cooperating member 20 is retained in a vertically movable manner by the lower portion of the bed 1*b* between upper and lower positions which correspond to the highest position (unoperated position) and the lowest position of the presser bar 11. The upper portion of the cooperating member 20 is linked to the lower end of the actuating bar 19.

A pair of front and rear legs 21 are protrusively provided on the lower surface of the bed 1*b* in the vicinity of the lower end of the cooperating member 20, and a rotary shaft 22 is so retained as to rotate around a horizontal axis between the above-described two legs 21. A support bracket 23 includes a pair of projecting portions 23*a* provided on the left upper surface thereof. The rotary shaft 22 is fixedly inserted in these projecting portions 23*a* so that they are integrally movable. The lower surface of the support bracket 23 is attached to a presser servo solenoid 24; and a protractible and retractable armature 25 is so protruded at the central portion of the upper surface of said servo solenoid 24 as to penetrate the support bracket 23.

The lower end of said cooperating member 20 is fitted in the upper end of this armature 25. The rear portion of the armature 25 is protrusively provided with a forked arm 26 extending in the horizontal direction, and the front portion thereof is likewise protrusively provided with a forked arm 27 extending in the perpendicular direction to said forked arm 26. On the upper surface of the support bracket 23 behind the armature 25 is projectingly provided a guide pin 28 for guiding the armature 25 which protracts and retracts by engaging with the horizontal forked arm 26. When the armature 25 of the presser servo solenoid 24 is made to protrude, the cooperating member 20 moves upwards, whereby the presser foot 10 ascends through said actuating bar 19, the first and second rocker levers 15, 17 and said needle bar clamp 12.

It is to be noted that an actuating means is composed by the presser bar 11, the needle bar clamp 12, the adjusting screw 13, the first rocker lever 15, the spring 16, the second rocker lever 17, the connecting bar 18, the actuating bar 19, the cooperating member 20 and the presser servo solenoid 24.

In front of the above-mentioned armature 25, a presser potentiometer 29 is mounted on the upper surface of the support bracket 23, and an actuating shaft 30 is provided on its right side. The proximal end of a rotary lever 31 is fixedly fitted to the actuating shaft 30. The terminal end of the rotary lever 31 is protrusively provided with a pin 31*a* which engages with the forked arm 27 of the armature 25. The armature 25 of the presser servo solenoid 24 juts out, and the presser foot is raised, at which time the actuating shaft 30 of the presser potentiometer 29 is rotated through said forked arm 27 and the rotary lever 31 by the protruding motion of the armature 25. Detecting signals corresponding to a protruding quantity of the armature 25 are outputted from the potentiometer 29.

As illustrated in FIG. 2, an operating member 32 which is press-manipulated by the right knee is fixed through a support bar 33 and an installing piece 34 to the front end of the rotary shaft 22. When the rotary shaft 22 is rotated in the counterclockwise direction of the Figure by dint of the press-manipulation of the operating member 32, the presser servo solenoid 24 as a whole is made to rotate from the position depicted in FIG. 2 to the upper side of almost the same direction as that in which the armature 25 is projected. Accompanied with this rotation, the cooperating member 20 ascends through said armature 25. Subsequently, the presser foot 10 is raised in proportion to an amount of operational displacement of the operating member 32.

It is to be remarked that a rotary range of the support bracket 23 is regulated by a regulation member (not illustrated) in accordance with a vertical moving range of the presser foot 10, and it invariably remains at the position shown in FIG. 2.

Figure 3:
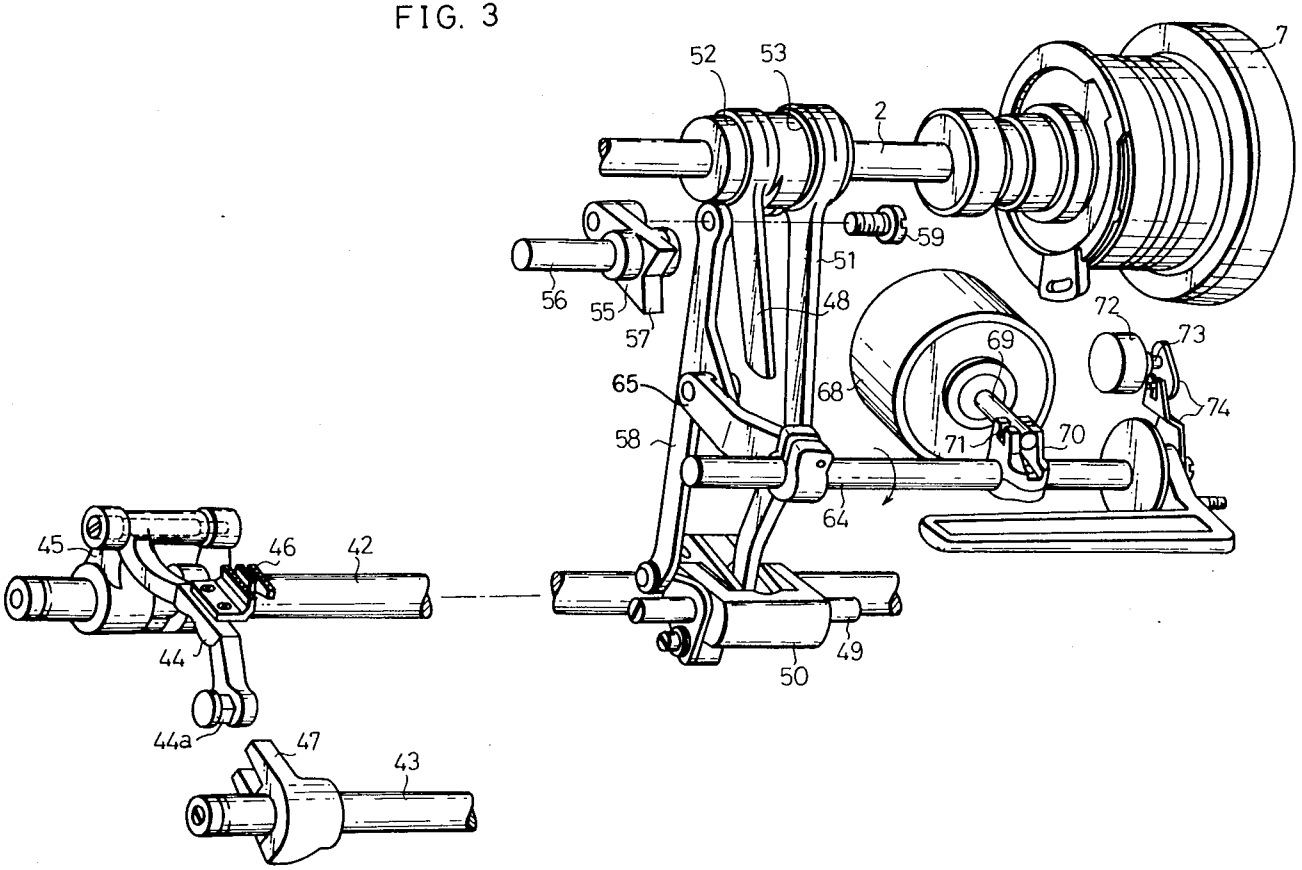

As depicted in FIG. 3, a horizontal feed shaft 42 and a vertical feed shaft 43 are rotatably supported within the bed 1*b*. A feed base 44 is rotatably linked through a support arm 45 to the horizontal feed shaft 42. A feed dog 46 is mounted on the upper surface of the feed base 44, this feed dog 46 being protractible and retractable with respect to the work fabric supporting surface of the bed 1*b*. The forked arm 47 attached to said vertical feed shaft 43 engages with an engaging projection 44*a* of the feed base 44.

A vertical feed eccentric cam 52 is mounted on the main shaft 2. Accompanied with the rotation of the vertical feed eccentric cam 52, a vertical feeding motion is imparted to the feed dog 46 through a crank rod 48, the vertical feed shaft 43 and the forked arm 47. A horizontal feed eccentric cam 53 is similarly mounted on the main shaft 2. A feed adjusting device 50 which rotates round a supporting shaft 49 is operationally linked to the horizontal feed shaft 42 to change a fabric feed direction and a fabric feed pitch. According to the rotation of the horizontal feed eccentric cam 53, a horizontal feeding motion synchronizing with said vertical feeding motion is imparted to the feed dog 46 through a crank rod 51, said feed adjusting device 50, said horizontal feed shaft 42 and said feed base 44. The work fabric feeding device is constituted by the feed dog 46 and the presser foot 10, and by virtue of the cooperation of the two components the work fabric 78 is fed.

As shown in FIGS. 3, 4, a feed adjusting member 55 is rotatably supported by the supporting shaft 56 at its almost central portion within the arm 1*a* of the machine frame 1, and the front side portion thereof is formed with a feed control cam 57 which assumes a substantially V-shaped configuration in side surface. A connecting bar 58 is rotatably linked at its upper end to the rear side portion of the feed adjusting member 55 by a screw 59, and its lower end thereof is rotatably linked to the feed adjusting device 50. The aforementioned adjusting member 55 is rotationally biased by a spring (not illustrated) in the clockwise direction of FIG. 4.

As illustrated in FIG. 4, in front of the feed adjusting member 55 an operating member 60 is rotationally driven into the arm 1*a* of the machine frame 1 at its intermediate screw portion 61. The operating member 60 is provided with an engaging projection 62 at the inner end thereof for regulatively holding the feed adjusting member 55 at a predetermined position while resisting the spring force of the above-described spring by engaging with the feed control cam 57 of the feed adjusting member 55. The outer end of the operating member 60 is provided with an operating dial 63. An oblique angle of the feed adjusting member 55 is varied while engaging the feed control cam 57 with the engaging projection 62 by turning the operating dial 63 and moving the operating member 60 back and forth. Concomitantly, the rotational angle of the feed adjusting device 50 is changed, whereby the fabric feed pitch and the direction of the feed dog 46 are varied. The fabric feed pitch is the feed quantity for one rotation of the main shaft 2.

As illustrated in FIG. 3, above the feed adjusting device 50, an actuating shaft 64 is rotatably supported in the arm 1*a*, the right end of which protrudes toward the externally right portion of the arm 1*a*. An actuating arm 65 is fixed to the left end of the actuating shaft 64, and the rear end thereof is rotatably linked to the intermediate portion of the connecting bar 58. When varying the fabric feed pitch by means of feed adjusting member 55, the actuating shaft 64 is arranged to turn to the position which corresponds to the fabric feed pitch through the connecting bar 58 and the actuating arm 65.

At the rear of the actuating shaft 64, a feed servo solenoid 68 is disposed within the arm 1*a*, the front end of the armature 69 is operationally linked via a coupling lever 70 and a pin 71 to the actuating shaft 64. The armature 69 protrusively moves forth by dint of the actuation of the feed servo solenoid 68, and the actuating shaft 64 makes a predetermined amount of rotation in the clockwise direction indicated by an arrowhead of FIG. 3, at which time the feed adjusting device 50 is rotated through the actuating arm 65 and the connecting bar 58 in the direction in which to decrease the fabric feed quantity. As a result, the fabric feed pitch is reduced.

As shown in FIG. 3, a feed potentiometer 72 for detecting the feed pitch is so attached to the right outer surface of the arm 1*a* as to correspond to the protrudent portion of the right end of the actuating shaft 64; and predetermined detection signals are outputted in accordance with the amount of rotation of the rotary shaft 73. Between the protrudent portion of the right end of the actuating shaft 64 and the rotary shaft 73 is disposed a communicating member 74 for communicating the rotary motion of the actuating shaft 64 to the rotary shaft 73.

Figure 5:
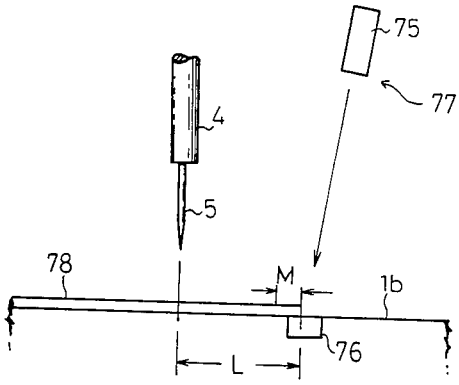

As illustrated in FIGS. 1, 5, a light emitting element 75 and a light receiving element 76 are disposed vis-a-vis with each other on the arm 1*a* and the bed 1*b* in the vicinity of the needle 5. A fabric end detector 77 consists of these elements 75, 76; and when the terminal of the work fabric 78 passes between the two elements 75, 76 during the sewing operation, detection signals are outputted from this fabric end detector 77.

Figure 6:
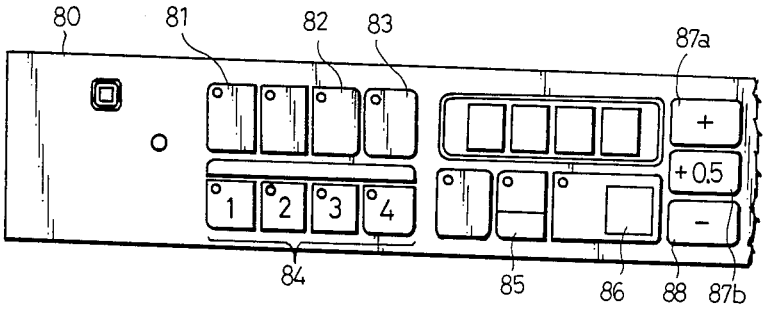

In the second place, a control system in the sewing machine relative to this embodiment will hereinafter be described. As illustrated in FIGS. 1, 6, a control panel 80 is disposed on the front surface of the arm 1*a*. On this panel are provided a memory key 81, an input key 82, a play back mode key 83, a pattern assignment key 84, a margin setting key 85, a clear key 86, addition keys 87*a*, 87*b* and a subtraction key 88. In this embodiment, the machine frame 1 is mounted on the working table (not illustrated), in which mounting state the machine frame 1 is equipped with an operating pedal 90 situated at the lower position of the bed 1*b*. In close proximity to this operating pedal 90 is disposed an interruption switch 91 (See FIG. 8) for generating interruption signals by a first depressing operation when being set a play back mode and for halting the generating of the interruption signals by a second depressing operation. An interruption signal generating means is constituted by this switch 91.

Figure 8:
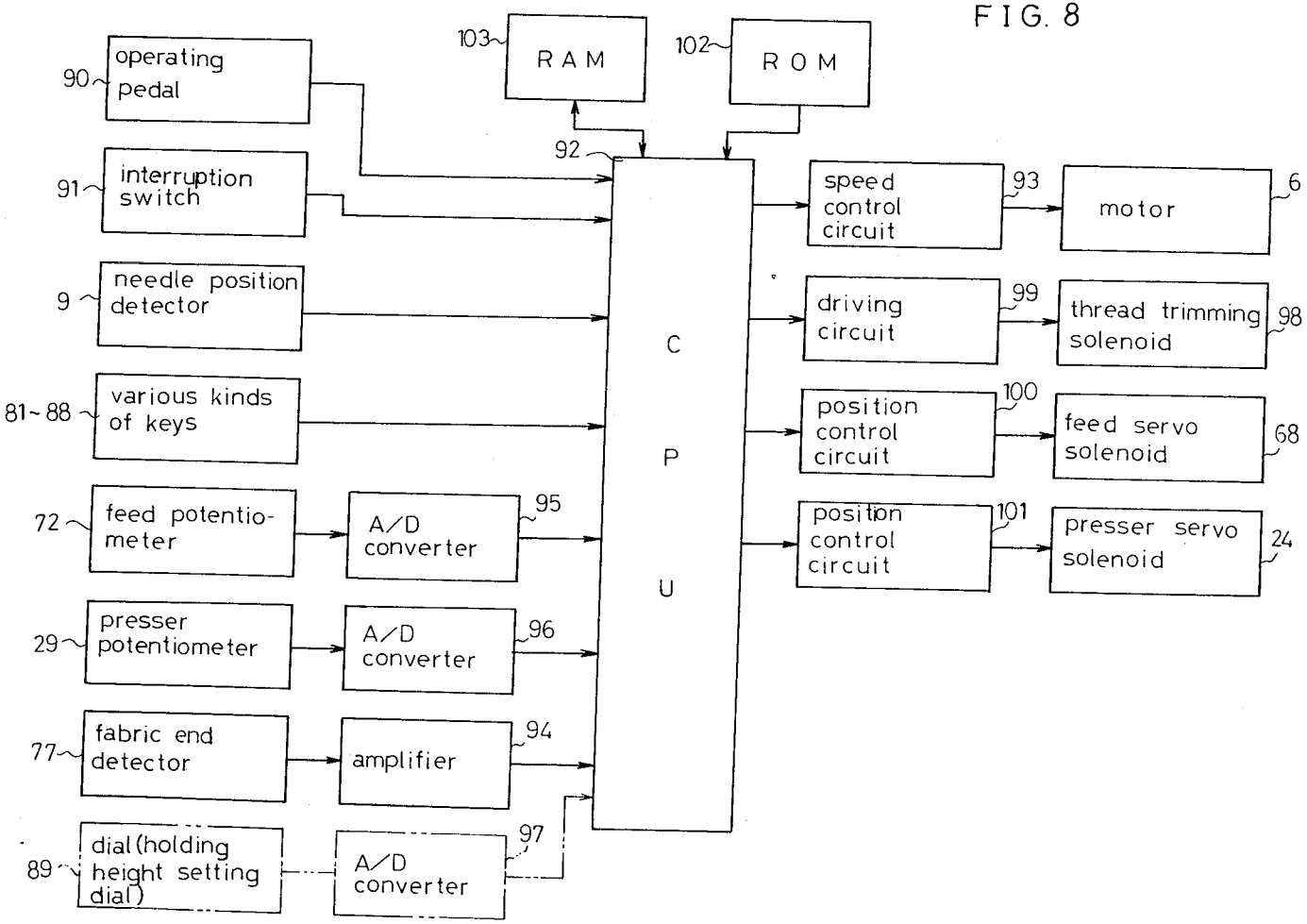

A central processing unit (CPU) 92 illustrated in FIG. 8 comprises a first control means, a second control means and a third control means. Said operating pedal 90 is connected to the CPU 92; and the CPU 92 drive-controls the motor 6 through a speed control circuit 93 in response to starting and stopping signals outputted on the basis of its operation. The detection signals outputted from the fabric end detector 77 are inputted via an amplifier 94 to the CPU 92. The feed potentiometer 72 outputs signals corresponding to the amount of rotation of the actuating shaft 64 illustrated in FIG. 3, and the output signals are inputted via an A/D converter 95 to the CPU 92.

The potentiometer 29 outputs signals corresponding to the amount of protrusion of the armature 25 of the presser servo solenoid 24, and the output signals are inputted via an A/D converter 96 to the CPU 92.

Furthermore, according to the operation of the memory key 81, the CPU 92 sets a storage sewing mode for storing sewing pattern data, and according to the operation of the play back key 83, the CPU 92 sets an automatic play back mode for performing the sewing operating on the basis of the previously stored sewing pattern data.

When the interruption signals are inputted from the interruption switch 91 to the CPU 92 under such a condition that the automatic play back sewing mode is set, the CPU 92 sets an ordinary sewing mode for carrying out an ordinary sewing operation regardless of the above-mentioned sewing pattern data. Simultaneously, the CPU 92 outputs actuating signals via the position control circuit 101 to the presser servo solenoid 24 in accordance with a height of the presser foot which is previously so stored in a RAM 103 as to correspond to the interruption sewing, thereby actuating the presser servo solenoid 24. Subsequently, the presser foot 10 is situated at the intermediate position between the highest position (unoperated position) and the lowest position. This intermediate position is set for the purpose of releasing the pressure which is preset for a high speed rectilinear sewing operation. It is desirable that the presser foot 10 softly presses the work fabric even in the intermediate position. The intermediate position may properly varied in proportion to a thickness of the work fabric. So far as this embodiment is concerned, in order to dispose the presser foot 10 at the thus varied intermediate position, a height of the presser foot 10 is detected by the presser potentiometer 29; and feedback control is effected to obtain the intermediate position that is set in the RAM 103. In the case of effecting the sewing operation in such a state that the ordinary sewing mode is set, no data on this sewing operation is stored.

The CPU 92 outputs the actuating signals through a driving circuit 99 to a thread trimming solenoid 98 designed for actuating a thread trimming device (not illustrated) at the completion of the sewing operation. Moreover, the CPU 92 outputs the actuating signals via the position control circuit 100 to the feed servo solenoid 68.

To the CPU 92 are connected a read only memory (ROM) 102 and a random access memory (RAM) 103, respectively. The ROM 102 stores programs for controlling the operations of the entire sewing machine, data of raising quantity of the presser foot 10 from the material supporting surface of the bed 1*b*, which correspond to the output signals transmitted from the presser potentiometer 29, and data of fabric feed pitch which correspond to the output signals sent from the feed potentiometer 72.

Figure 7:
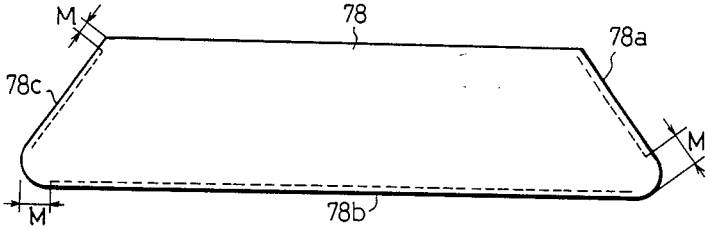

On the other hand, the RAM 103 is provided with four memory areas corresponding to the pattern number on the pattern assignment key 84; and the sewing pattern data are stored in these memory areas. These sewing pattern data involve: the fabric feed pitch data that are to be detected by the feed potentiometer 72; a phase, that is, a ratio between the work fabric feed quantity calculated on the basis of the sewing operation from the time at which the work fabric end was detected to the time at which the needle 5 penetrates the work fabric next and a previously stored fabric feed pitch; a distance L (See FIG. 5) from the fabric end detecting position detected by the fabric end detector 77 to the needle dropping position; a margin M (it is deemed that this margin includes a space from the final needle dropping point in the respective hems 78*a* to 78*c* to the fabric end when performing the sewing operation along, for instance, the above-mentioned hems 78*a* to 78*c* of the work fabric 78 shown in FIG. 7) which is preset on the basis of the operations of the margin setting key 85 or the like; and the number of stitches required for a sewing process from the passage of the work fabric over the detecting position and a reduction rate of said fabric feed pitch that was previously stored.

The operations of the thus constructed sewing machine will next be described. In the memory areas of the RAM 103 illustrated in FIG. 8 are stored the margin data corresponding to the sewing of the work fabric 78 and various kinds of actuating condition data, such as timings for driving the motor, the presser servo solenoid 24, the servo solenoid 68, and the thread trimming solenoid, by effecting a storage sewing operation to form stitches along the individual hems while setting the margin M with the help of the operations of the margin setting key 85 or the like for each of the hems 78*a*, 78*b*, 78*c* of, for example, the work fabric 78 shown in FIG. 7, after setting a storage sewing mode by manipulating the memory key 81. This storage sewing operation is performed for the purpose of getting data required for forming stitches along each of the hems 78*a*, 78*b*, 78*c* without arc portions of the work fabric 78.

It is to be noted that since the storage sewing based on the fabric end detection is impossible with respect to the circularly arc end portion of the work fabric 78, the sewing data of this portion are not stored.

In order to carrying out the automatic play back sewing on the basis of the above-mentioned data, when a power source is inputted to the sewing machine, the presser servo solenoid 24 is energized, whereby the presser foot 10 is disposed at the highest position. The work fabric 78 is set on the work fabric supporting surface, and the sewing mode key 83 is operated. Subsequently, a result of judgement in a step 1 of FIG. 9 becomes YES, thereby setting the automatic play back sewing mode. When any one of the pattern assignment keys 84 is manipulated in a step 2, the CPU 92 designates the memory area of the RAM 103 which corresponds to the pattern number.

It is judged as to whether the switch 91 is operated or not in a step 3. At the first onset, however, there is performed the sewing operation along the hem 78*a* of the work fabric 78 shown in FIG. 7 and hence the interruption switch 91 is not operated. Consequently, the result of judgement is turned out to be NO. In a step 4, when depressing the operating pedal 90 and starting signals are thereby outputted, the presser servo solenoid 24 is deenergized in a step 5. With this process, the armature 25 is retracted, thereby causing the presser foot 10 to descend down onto the work fabric 78 through the cooperating member 20 or the like. Subsequently, a preset holding pressure employed for the high speed rectilinear sewing operation is imparted to the work fabric 78.

Figure 9:
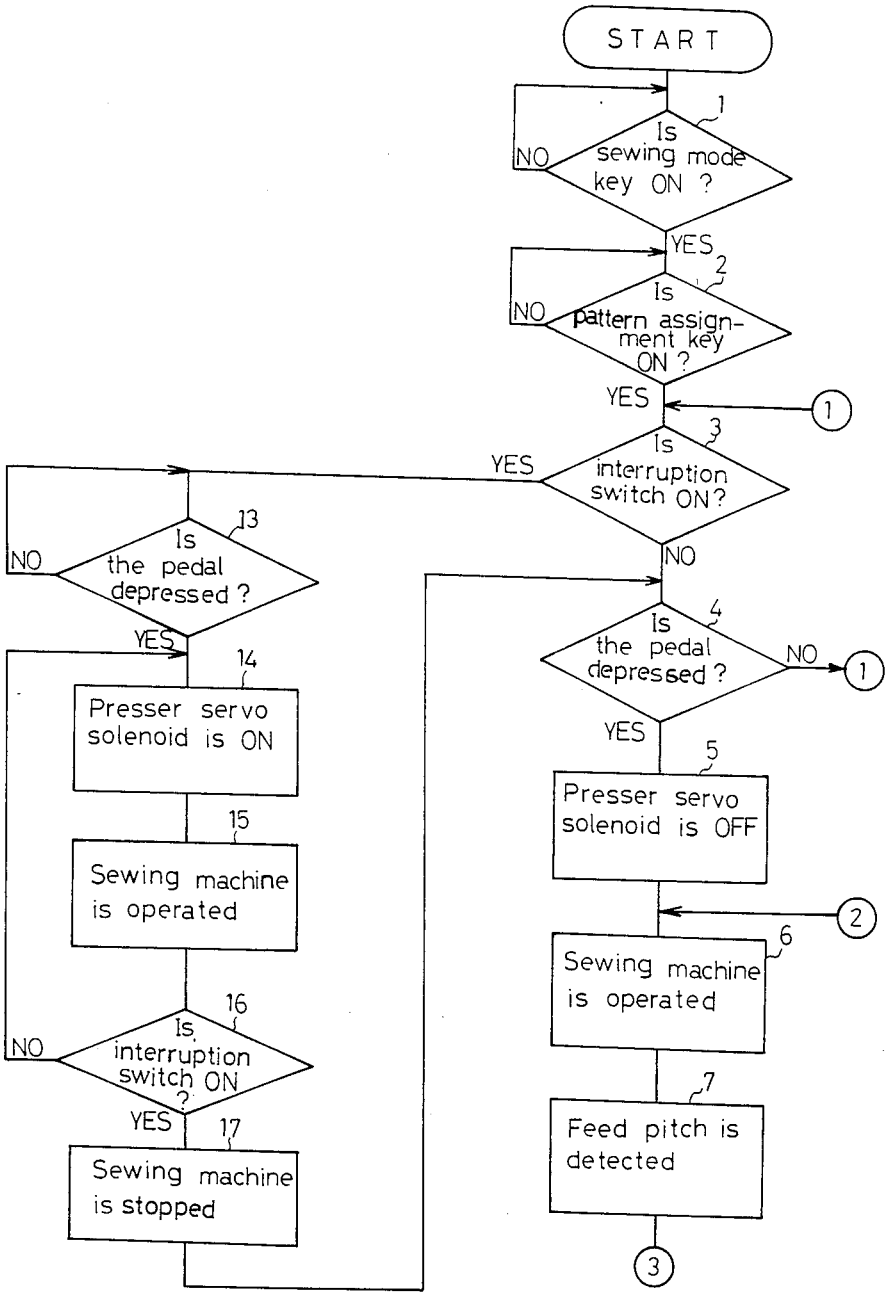
Figure 10:
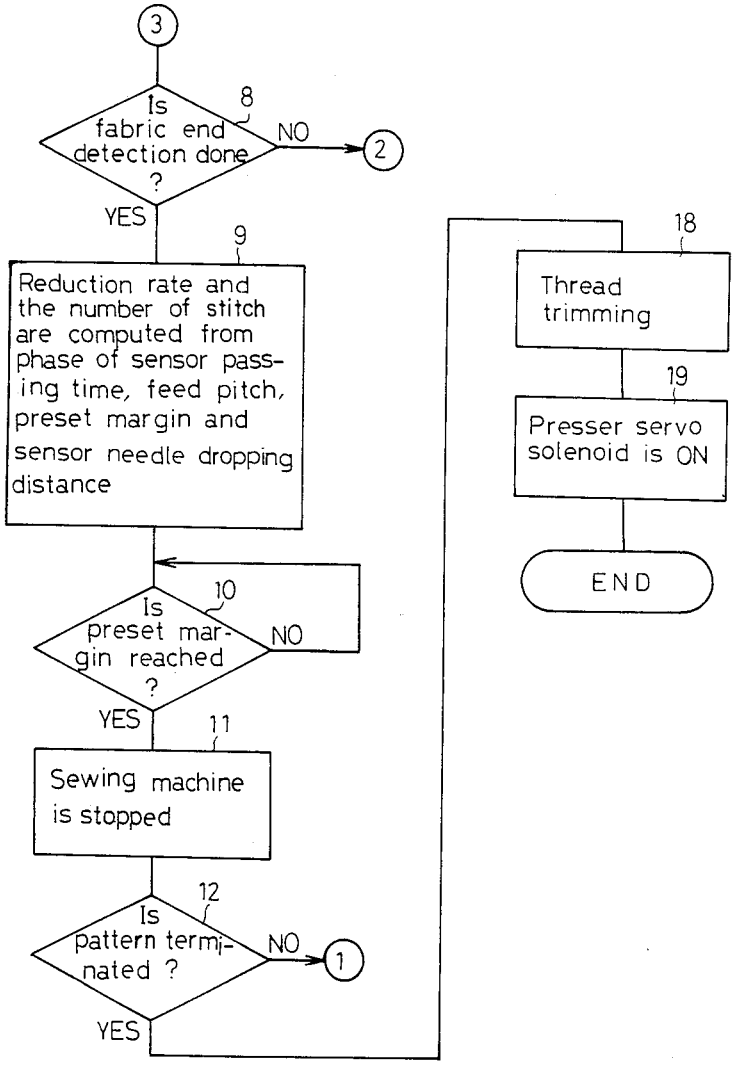

In such a state, the motor 6 is driven in a step 6, thus driving the sewing machine. On the occasion of operating the sewing machine, signals corresponding to the amount of rotation of the actuating shaft 64 shown in FIG. 3 are outputted from the feed potentiometer 72. On the basis of said signals, the fabric feed pitch is stored in the RAM 103. Until the detection signals are outputted from the fabric end detector 77, the processings of the steps 6 to 8 described in FIGS. 9, 10 are repeated. Upon the outputting of the fabric end detection signals, the CPU 92 computes both the number of stitches and the reduction rate of the fabric feed pitch required for an operation ranging from the fabric end detection to the margin on the basis of the data such as the phase obtained at the time of detecting the fabric end (the time when the fabric end passed over the light receiving element 76 of the fabric end detector), the previously detected fabric feed pitch, the preset margin M and the distance L between sensor 76 and needle dropping position; and then the CPU 92 arranges for the RAM 103 to store the data in a step 9 shown in FIG. 10. (The data is the number of stitches and the reduction rate of the fabric feed pitch.)

Thereafter, if it is judged that the sewing operation up to the preset margin M upon said stored data is completed in a step 10, the process moves to a step 11 wherein the sewing machine is stopped. It is judged as to whether all the sewing operations corresponding to the sewing patterns is completed or not in a step 12, since the sewing operation of the hem 78*a* alone of the work fabric 78 is finished, the result of judgement in the step 12 becomes NO, the process inevitably returns to the step 3.

Subsequently, when the interruption switch 91 is operated in order to perform the sewing operation along the circularly arc portion extending to the hem 78*a*, the result of judgement in the step 3 comes to YES, whereby the CPU 92 sets the ordinary sewing mode in response to the interruption signals from the interruption switch 91. When the operating pedal 90 is depressed in a step 13, the CPU 92 energizes the presser servo solenoid 24 in order to dispose said presser foot 10 at intermediate position which is so preset as to correspond to the interruption sewing. At this time, the presser foot 10 applies a pressure that is weaker than that employed in the play back sewing mode to the work fabric 78, the presser foot 10 being in a state in which to readily change the feeding direction while performing the sewing operation. It is to be remarked that the sewing operation may be carried out by the manual feed of the operator while causing the presser foot 10 to be spaced from the upper surface of the work fabric 78.

Till the operation of the interruption switch 91 resumes in a step 16, the CPU 92 keeps on driving said motor 6 at a low speed in a step 15. Meantime, the pressure by said presser foot 10 is released and it is therefore feasible to smoothly form the stitches along the circularly arc portion of the work fabric 78.

The interruption switch 91 is operated once again in the step 16, and the result of judgement becomes YES. As a result, the sewing machine is stopped in a step 17, and at the same time the CPU 92 causes the automatic play back mode to revert, whereby the process returns to the step 4.

By virtue of the re-execution of the processings of the steps 4 to 12 inclusive, it is possible to perform the sewing operation along the hems 78*b*, 78*c* of the work fabric 78. Interruption processings of the steps 13 to 17 inclusive are carried out during the sewing operation of the hems 78*b*, 78*c*, which makes it possible to effect the sewing along the circularly arc portion between the hems 78*b*, 78*c*. What's more, after all the sewing operations have been terminated, the result of judgement comes to YES in the step 12. At this time, the process moves to a step 18 wherein the CPU 92 outputs the actuating signals to the thread trimming solenoid 98, thereby effecting a thread trimming operation. In the wake of this step, the presser servo solenoid 24 is actuated, and the presser foot 10 is raised to the highest position.

As described above, in this embodiment, the interruption switch 91 is manipulated in such a state that the automatic play back mode is set. At this time, the ordinary sewing mode is set, and simultaneously the presser foot 10 is ascended thereby to release the pressure. It is therefore possible to smoothly feed the fabric along the circularly arc portion. Owing to this advantage, it is feasible to flexibly deal with the sewing of the work fabric 78 which may assume multiple configurations.

Figure 11:
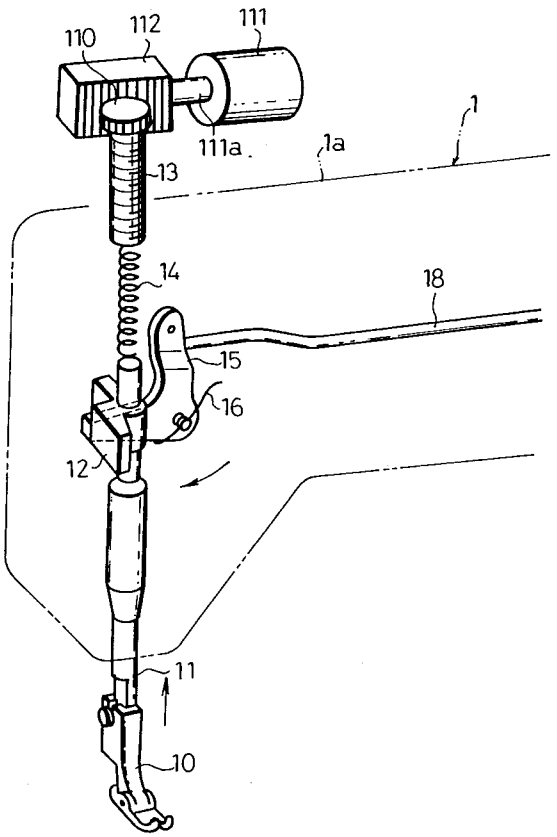
FIG. 11 is a view corresponding to FIG. 2, showing another embodiment of the present invention.

Another embodiment of the present invention will hereinafter be described with reference to FIG. 11. This embodiment is different in the following points from the former embodiment so far explained. To be specific, a pinion 110 is fixed to the head of an adjusting screw 13, and a rack 112 engaging with the pinion 110 is placed horizontally movable above the upper surface of the arm 1*a*. An armature 111*a* of a holding pressure adjusting servo solenoid 111 is linked to the rack 112. With the servo solenoid 111 actuated, the adjusting screw 13 is adjusted so that it moves verticaly by engaging the rack 112 with the pinion 110. Therefor, the pressure given to the work fabric 78 by a spring 14 is adjusted. An actuating means consists of the pinion 110, the holding pressure adjusting servo solenoid 111 and the rack 112.

In this embodiment, when a power source is inputted for the purpose of carrying out the sewing operation, the CPU 92 outputs the actuating signals to the pressure adjusting servo solenoid 111 to actuate this servo solenoid 111, thus setting the predetermined pressure. In such a state, on the occasion of the interruption signals being generated during the automatic play back sewing, responsively the CPU 92 actuates the pressure adjusting servo solenoid 111 and moves the rack 112 in a given direction. With this process, the rack 112 is made to engage with the pinion 110 thereby to raise the adjusting screw 13. Subsequently, the pressure applied by the spring 14 is released.

When the occurrence of the interruption signals ceases, the CPU 92 arranges for the servo solenoid 111 to revert to the actuation, thus setting said predetermined pressure.

Hence, in this embodiment as well as in the previous embodiment, when the interruption signals are generated in a state in which to set the automatic play back mode, the ordinary sewing mode is set, and simultaneously the pressure by said presser foot 10 is released. It is therefore feasible to smoothly feed the fabric along the circularly arc portion.

It is to be remarked that the present invention is not confined to the above-described embodiments, but may be materialized in the following modes.

Namely:

(a) As shown by two-dot lines in FIGS. 1, 8, there is provided a presser foot ascent setting dial 89 for setting an ascent position of the presser foot 10 on the left lower surface of the bed 1*b*; signals that are to be outputted in accordance with the amount of turning operation thereof are inputted via an A/D converter 97 to the CPU 92; ascent data according to said signals are stored in the RAM 103; and the presser foot 10 is made to ascend on the basis of the stored data at the time of interruption sewing. In the embodiment described in FIG. 11, the pressure by the presser foot 10 that is released in time of the ordinary sewing operation may be set by controlling the servo solenoid 111 in accordance with the output signals of the aforecited dial 89.

(b) The interruption switch 91 is disposed vis-a-vis with the operating member 32 so that this switch 91 can be manipulated by the left knee.

(c) The sewing data required for a seam having a predetermined length is arranged to be stored by setting the number of the needle and inputting it.

As many apparently widely different embodiments of this invention may be made without departing from the spirit and scope thereof, it is to be understood that the invention is not limited to the specific embodiments thereof except as defined in the appended claims.

What is claimed is:

1. A sewing machine having an automatic control system comprising a stitch forming means including a needle reciprocating across a material disposed on a material supporting surface;

a material feeding means including a feed dog capable of making horizontal and vertical motions in synchronism with the reciprocation of said needle and a presser foot cooperating with said feed dog, said presser foot being movable between a lower position at which it presses said material to said feed dog and an upper position at which it is apart from said feed dog;

an urging means for applying a pressure to said presser foot;

an actuating means for substantially releasing the pressure against the material by the presser foot;

a storage means for storing predetermined data for forming a desired stitch length;

a first control means possessed of a plurality of modes for controlling said stitch forming means and material feeding means, said first control means having an automatic mode for forming stitches in accordance with said data and an ordinary mode for forming stitches independently of said data;

an interruption signal generating means for generating an interruption signal during a sewing process in each of said sewing modes;

and a second control means for setting said first control means in said ordinary mode and controlling said actuating means upon generation of said interruption signal during a process in said automatic mode.

2. A sewing machine having an automatic control system according to claim 1, wherein said actuating means raises said presser foot from the lower position to a predetermined upper position.

3. A sewing machine having an automatic control system according to claim 2, wherein said upper position is set by manually operating a setting means.

4. A sewing machine having an automatic control system according to claim 1, wherein said actuating means includes a servo solenoid having an extendible and retractable armature, whereby said presser foot ascends through an extension of the armature.

5. A sewing machine having an automatic control system according to claim 1, wherein said actuating means includes an adjusting screw for adjusting the pressure of the presser foot, a driving means for rotating the adjusting screw.

6. A sewing machine having an automatic control system according to claim 5, wherein said driving means includes a pinion formed on a head portion of said screw, a rack engaging said pinion, a servo solenoid for horizontally reciprocating said rack.

7. A sewing machine having an automatic control system according to claim 1, wherein said interruption signal generating means includes a manually operable interruption switch.

8. A sewing machine having an automatic control system, comprising:

a stitch forming means including a needle reciprocating across a material on a material supporting surface;

material feeding means including a feed dog capable of making horizontal and vertical motions in synchronism with the reciprocation of said needle and a presser foot cooperating with said feed dog, said presser foot being movable between a lower position at which it presses said material to said feed dog and an upper position at which it is apart from said feed dog;

an urging means for applying the pressure to said presser foot;

an actuating means for substantially releasing the pressure against the material by the presser foot;

a storage means for storing predetermined data for forming desired stitch;

a first control means possessed of a plurality of modes for controlling said stitch forming means and material feeding means, said first control means having an automatic mode for forming stitches in accordance with said data and an ordinary mode for forming the stitches independently of said data;

an interruption signal generating means for generating an interruption signal during a sewing process in each of said sewing modes;

a second control means for setting said first control means in said ordinary mode and controlling said actuating means upon generation of said interruption signal during a sewing process in said automatic mode;

and a third control means for setting said first control means in said automatic mode and deactivating said actuating means when said interruption signal ceases to be generated during the process in said ordinary mode.

9. A sewing machine having an automatic control system according to claim 8 wherein said storage means includes a group of a plurality of stitch data each corresponding to the length of the respective straight sides of the material.

* * * * *